United States Patent [19]

Sagawa et al.

[11] 4,361,820

[45] Nov. 30, 1982

[54] HYBRID MICROWAVE CIRCUIT

[75] Inventors: Morikazu Sagawa, Kawasaki; Mitsuo Makimoto, both of Yokohama; Sadahiko Yamashita, Sagamihara, all of Japan

[73] Assignee: Matsushita Electric Industrial Company, Limited, Osaka, Japan

[21] Appl. No.: 197,331

[22] Filed: Oct. 15, 1980

[30] Foreign Application Priority Data

Oct. 17, 1979 [JP] Japan ..... 54-134573

[51] Int. Cl.[3] ..... H01P 1/202; H01P 5/08; H01P 7/04

[52] U.S. Cl. ..... 333/206; 333/21 R; 333/222

[58] Field of Search ..... 333/21 R, 24 R, 24 C, 333/33, 134, 202-208, 219-231, 245-246, 260; 334/41-45, 85; 331/101, 96

[56] References Cited

U.S. PATENT DOCUMENTS 4,268,809 5/1981 Makimoto et al. ..... 333/207

FOREIGN PATENT DOCUMENTS 512620 2/1955 Italy ..... 333/246

*Primary Examiner*—Marvin L. Nussbaum

*Attorney, Agent, or Firm*—Lowe, King, Price & Becker

[57] ABSTRACT

A coaxial type microwave filter having an outer conductor and at least one inner conductor supported in the outer conductor has a strip transmission line extending from an external strip-line circuit to the inner conductor through an opening in the outer conductor. The strip transmission line includes a dielectric member forming an integral part of the dielectric substrate of the external circuit and a thin layer of conductive strip also forming an integral part of the conductive film pattern of the external circuit. The extending strip transmission line is electromagnetically coupled with the inner connector to permit the two microwave circuits to be interconnected with no use of a connector.

5 Claims, 5 Drawing Figures

HYBRID MICROWAVE CIRCUIT

FIELD OF THE INVENTION

The present invention relates to a microwave filter of the type having at least one inner conductor mounted coaxially in an outer conductor, and more specifically to a connector for connecting such microwave filters to a printed circuit, particularly microwave integrated circuit.

BACKGROUND OF THE INVENTION

Microwave filters of the coaxial type are usually provided with coaxially structured terminals for connection with external circuit modules and such connection is provided by a coaxial cable or the like. Each terminal is provided with a probing electrode which projects into the filter interior for energy transfer. In cases where a system is desired to meet low-loss requirements, a hybrid construction is often employed in which such microwave filters are connected to strip line circuit modules such as integrated circuits. This requires a specially designed connector that provides mode conversion between different field configurations of the dominant mode. However, an abrupt structural change tends to occur at the connecting point, so that impedance mismatch is introduced.

SUMMARY OF THE INVENTION

Accordingly, an object of the invention is to permit connection between a coaxial type microwave filter and a strip-line circuit without introducing impedance mismatch between them.

Another object of the invention is to provide a microwave filter of coaxial type comprising at least one inner conductor mounted in an outer conductor and a strip-line forming an integral part of an external strip-line circuit, such as microwave integrated circuit, the strip line comprising a dielectric substrate extending from said external circuit to the inner conductor through an opening in the outer conductor and a conductive film secured to and extending along the dielectric substrate to a point which is located a short distance from the inner conductor to establish a reactive coupling therewith.

A further object of the invention is to provide a hybrid microwave circuit comprising a microwave filter of coaxial type and a strip-line circuit including a dielectric substrate having a portion extending into said filter and secured to the inner conductor of the filter and a printed circuit having a portion secured to and extending along said substrate portion to a point located a short distance from the inner conductor to establish a reactive coupling therewith.

Therefore, a still further object of the invention is to eliminate the use of a separate connector between different circuit modules of a hybrid microwave circuit.

BRIEF DESCRIPTION OF THE DRAWINGS

The invention will be further described by way of example with reference to the accompanying drawings, in which.

DETAILED DESCRIPTION

Figure 1:
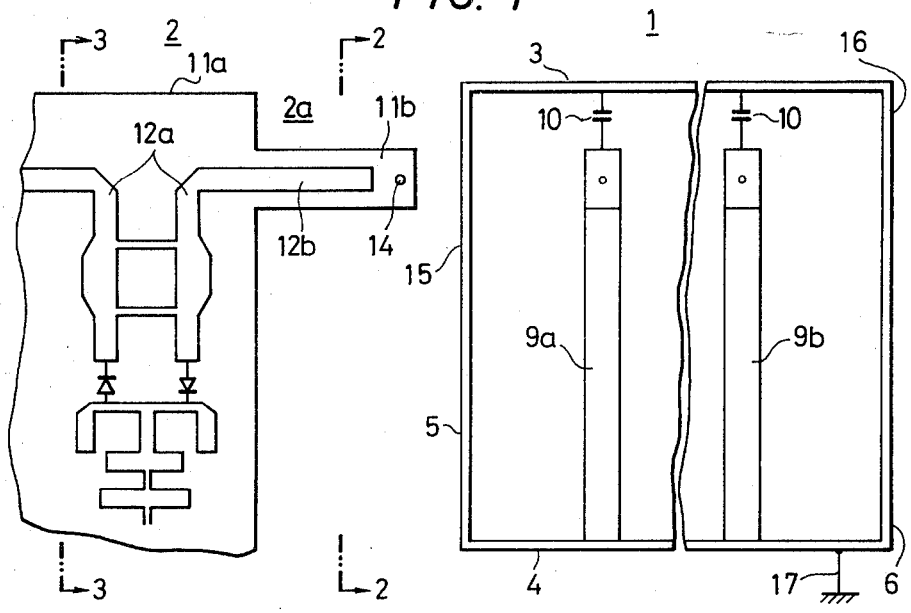
FIG. 1 is an illustration of an embodiment of the invention with a microwave filter shown separately from an external microstrip.

In FIGS. 1 to 4 of the drawings, a preferred embodiment of the invention is illustrated. In FIG. 1, a coaxial type microwave filter 1 and a strip-line circuit 2 such as integrated circuit are separately shown. The microwave filter comprises an outer conductor of a box-shaped configuration having side walls 3, 4 and end walls 5, 6 and top and bottom walls 7 and 8. A plurality of inner conductors 9 (only two of which are illustrated) is supported within the outer conductor spaced from the top and bottom walls extending parallel with each other between side walls 3 and 4. A capacitor 10 is preferably provided for each inner conductor between its free end and side wall 3.

The strip-line circuit, or microstrip 2 includes a printed circuit 12*a* of a mixer, for example, formed by etching a thin layer of metal of a dielectric substrate 11*a* preferably having a small dielectric loss (particularly when frequency is relatively high in the microwave region). Strip-line circuit 2 further includes an extension 2*a* formed by a dielectric substrate 11*b* which is an integral part of substrate 11*a* and a conductive film strip 12*a* which extends from film 12*a* to a point a little distance away from the end of substrate 11*b*. Near the end of extending substrate 11*b* is provided a screw hole 14.

Figure 4:
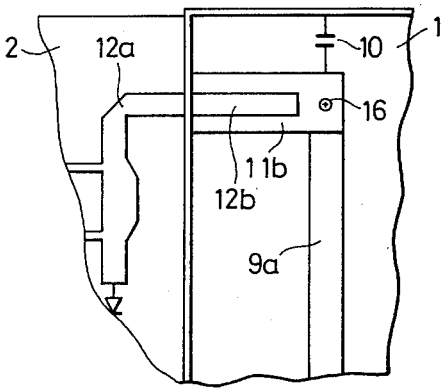
FIG. 4 is an illustration of the embodiment of FIG. 1 with the microwave filter being coupled with the external circuit.
Figure 2:
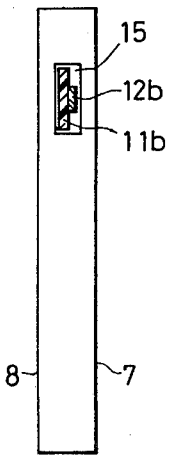
FIG. 2 is an illustration of a cross-sectional view taken along line 2—2 of FIG. 1.
Figure 3:
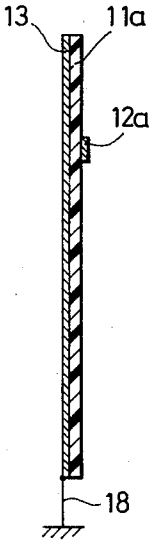
FIG. 3 is an illustration of a cross-sectional view taken along line 3—3 of FIG. 1.

On the end wall 5 of microwave filter 1 is provided an insertion hole 15 as shown in FIG. 2 through which extension 2*a* of strip-line circuit 2 is inserted into filter 1. When the two circuit modules 1 and 2 are assembled together to form a hybrid circuit the extension 2*a* of strip-line circuit 2 is inserted through hole 15 and substrate portion 11*b* is secured to inner conductor 9*a* by means of a screw 16 as illustrated in FIG. 4. In this illustrated position, the end of strip film 12*b* is spaced a distance from inner conductor 9*a* to establish a reactive coupling between them. Preferably, the two circuit modules are grounded as at 17 and 18 after assemblage. A connecting path is thus established between strip-line circuit 2 and microwave filter 1. If circuit 2 is an input external circuit, microwave energy is injected through extending portion 2*a* into the interior of filter 1 and propagates through the parallelly arranged inner conductors to the output side. Although not shown in the drawings, an output external circuit similar to circuit 2 may be connected to inner conductor 9*b* through an opening 16 formed on end wall 6.

It is appreciated that, since the external circuit directly extends into the microwave filter, extension 2*a* serves not only as the probing electrode of the conventional microwave filter but as a connecting path for microwave energy, so that smooth energy transfer is achieved with the result that no impedance mismatch occurs at the coupling point. Therefore, the interconnected circuit modules can be considered as a single, impedance-matched circuit. This permits frequency adjustment of filter 1 with the use of a terminating load resistor having a resistance value other than 50 ohms, the impedance of microstrip 2 looking from the strip 126 toward the strip 12*a*.

A further advantage of the present invention is that the two circuit modules of different field configuration can be interconnected with greater ease and precision than is possible with conventional hybrid circuits and that a specially designed connector is not required.

Figure 5:
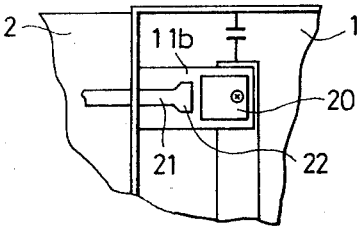
FIG. 5 is an illustration of a modified embodiment of the invention.

FIG. 5 is an illustration of modification of the present invention which differs from the previous embodiment in that the stripline-to-coaxial transition point is achieved by a capacitive coupling formed by a conductive film 20 and a microstrip line 21 having an enlarged portion 22 spaced from the film 20. The microstrip line 21 extends from microstrip 2 which may be formed by triplate-type transmission lines.

It is to be noted that the coaxial-stripline transition point may be provided at any point along the length of inner conductor 9*a* by appropriately forming the conductive pattern of strip 12*a* according to the field configuration of the connecting point. Formation of microstrip lines can be made with ease if the dielectric substrate is formed, for example, of a Teflon glass laminate.

What is claimed is:

1. A microwave filter comprising an outer conductor having an opening, at least one inner conductor supported in said outer conductor, and a strip transmission line forming part of an external strip-line circuit and comprising a dielectric substrate extending between said external circuit and said inner conductor through said opening, supporting said inner conductor, and a thin layer of conductive strip on said dielectric substrate extending from said external circuit through said opening and electrically isolated from said outer conductor to a point spaced from said inner conductor.

2. A microwave filter as claimed in claim 1, wherein said external circuit is a microstrip.

3. A microwave filter as claimed in claim 1, wherein said opening is formed on an end wall of said outer conductor.

4. A microwave filter as claimed in claim 1, wherein said strip transmission line further includes a conductive film electrically connected to said inner conductor through said dielectric substrate and laterally spaced from said conductive strip to establish a capacitive coupling therebetween.

5. A hybrid microwave circuit comprising:

a microwave filter including an outer conductor having an opening therein and at least one inner conductor supported in said outer conductor;

a microwave integrated circuit comprising a dielectric substrate, an overlying layer of conductive strip on said substrate and an underlying conductive layer beneath said substrate having, respectively, an integral outwardly extending dielectric portion and an internal, outwardly extending conductive strip portion, said integral portions extending into said microwave filter through said opening to establish a smooth transitory coupling with said inner conductor, said conductive strip portion being electrically isolated from said outer conductor and terminating at a point spaced from said inner conductor, said underlying conductive layer making contact with said outer conductor, said dielectric portion supporting said inner conductor.

* * * * *